United States Patent [19]

Graf

[11] Patent Number: 5,072,529

[45] Date of Patent: Dec. 17, 1991

[54] ICE SKATE

[75] Inventor: Karl Graf, Kreuzlingen, Switzerland

[73] Assignee: Graf & Co. Sportschuhfabrik Kreuzlingen, Kreuzlingen, Switzerland

[21] Appl. No.: 624,511

[22] Filed: Dec. 7, 1990

Related U.S. Application Data

[63] Continuation of Ser. No. 312,896, Feb. 17, 1989, abandoned.

[30] Foreign Application Priority Data

Feb. 19, 1988 [CH] Switzerland ..... 617/88

[51] Int. Cl.[5] ..... A43B 5/16; A43B 7/20

[52] U.S. Cl. ..... 36/115; 36/89

[58] Field of Search ..... 36/115, 50, 71, 88, 36/89, 93, 69, 119; 280/11.12, 11.13, 11.17, 11.18

[56] References Cited

U.S. PATENT DOCUMENTS

| | | | |
|---|---|---|---|
| 2,617,207 | 11/1952 | Jennett | 36/71 |
| 3,494,054 | 2/1970 | Lange | 36/50 |
| 3,977,098 | 8/1976 | Chalmers | 36/71 |
| 4,776,111 | 10/1988 | Crowley | 36/69 |

FOREIGN PATENT DOCUMENTS

| | | | |
|---|---|---|---|
| 1066501 | 11/1979 | Canada | 36/115 |
| 1097062 | 3/1981 | Canada | 36/115 |
| 0273891 | 7/1988 | European Pat. Off. | 36/114 |
| 0117372 | 9/1989 | European Pat. Off. | 36/115 |
| 154203 | 3/1938 | Fed. Rep. of Germany | 36/50 |
| 869754 | 1/1953 | Fed. Rep. of Germany | 36/50 |
| 2589688 | 5/1987 | France | 36/71 |
| 2605193 | 4/1988 | France | 36/50 |
| 128449 | 11/1928 | Switzerland | 36/50 |

*Primary Examiner*—Steven N. Meyers

*Attorney, Agent, or Firm*—Richard M. Barnes

[57] ABSTRACT

The ankle section of an ice skate, especially an ice hockey skate, should press as little as possible on the ankle of the foot inserted therein, even with tight lacing of the ice skate. For this purpose, the ankle section of the ice skate leg is provided with a recess, and this recess is filled with a pad. The ice skate leg is provided, in the ankle section, with a pivotable leg flap, by means of which the recess and the pad lying therein is coverable from outside. The leg flap is provided with a second lacing region, which cooperates with the other leg lacing. Upon movements of the foot relative to the leg, the pad does not shift relative to the ankle, thus does not rub on the ankle, and accommodate these movements by flexible deformation.

1 Claim, 1 Drawing Sheet

ICE SKATE

This is a continuation, of application Ser. No. 312,896, filed Feb. 17, 1989, entitled Ice Skate, now abandoned.

SUMMARY OF THE INVENTION

This invention relates to an ice skate. The ankle section of an ice skate, especially an ice hockey skate, should press as little as possible on the ankle of the foot inserted therein, even with tight lacing of the ice skate. In order to achieve this, the most diverse measures have already been taken. Thus, the ankle section of the ice skate leg was provided with respective pads and in the ice skate leg special recesses were provided in the angle section. Upon movements of the foot relative to the leg, high stresses arise in the material in the heel region and in the lacing region of the ice skate leg, which stresses often lead to tears in the leg material after a certain span of time. In order to remedy this, it is known to provide relief slots in the heel region and in the lacing region in order to diminish the stresses mentioned. Up to now, however, it was not possible to prevent the pad located in each ankle section in the ice skate leg from moving relative to the ankle when the foot moved relative to the leg, that is, to prevent said pad from rubbing on said ankle and, because of the high surface pressure present, often giving rise to irritation or even inflammation of the ankle section on the foot.

It is now an objective to create an ice skate with which avoids this problem.

The ice skate in accordance with the invention is characterized by the fact that the ice skate leg is provided with recesses in its lacing region; that these leg recesses are each filled with an ankle pad; and that each ankle pad is coverable by a leg flap attached to the ice skate leg, which leg flap exhibits a second lacing region.

DETAILED DESCRIPTION OF THE INVENTION

Figure 1:
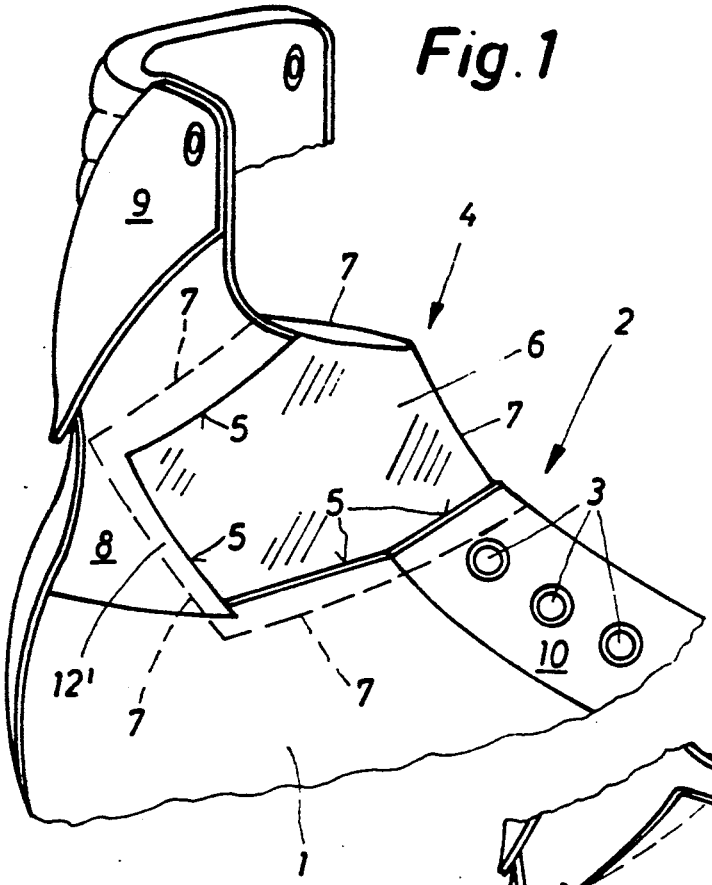
FIG. 1 is a side view of an ice skate of the invention with the leg flap omitted.

The ice skate shown in FIG. 1 exhibits a skate leg 1 made of, for example, full-grain cowhide. The skate leg 1 has a lacing region 2 with the eyelets 3. The lacing region 2 is provided, laterally on either side, with a tongue, not illustrated, with a recess 4, said recess having the contour as shown by the outlines 5. The recess 4 is filled by an ankle pad 6. The pad 6 has an approximately rectangular outline and is bounded by the outlines 7. As FIG. 1 shows, the outlines 7 of the pad 6 reach past the outlines 5 of the recess 4. The region by which the outlines 7 reach past the outlines 5 serves for sewing of the ankle pad 6 to the skate leg 1. As seen in FIG. 1, the ankle pad 6 is attached to the skate leg 1 along at least three sides of the pad. This aforementioned overlapping region thus accommodates these fastening seams.

Figure 2:
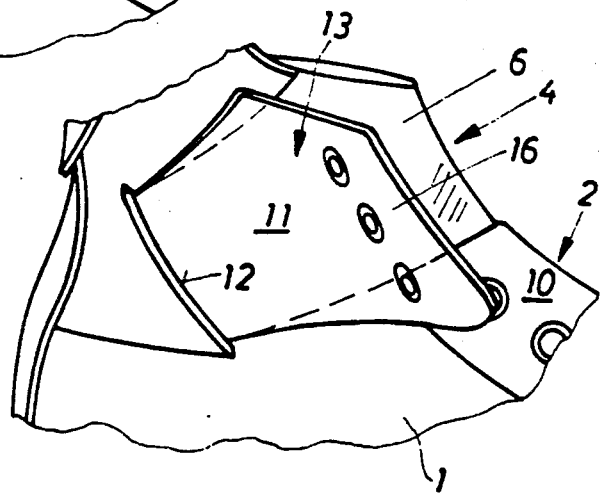
FIG. 2 is a side view of an ice skate of the invention with the leg flap pivoted away from the skate.
Figure 3:
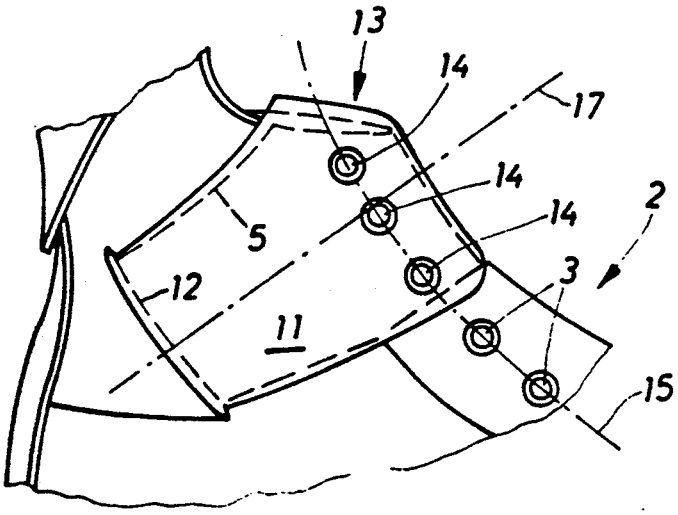
FIG. 3 is a side view of an ice skate of this invention with the leg flap in its normal position.

The skate leg 1 itself also exhibits sewn-on reinforcing points 8, 9 and 10. In accordance with the invention, each ankle pad 6 is coverable by a leg flap 11 fastened to the skate leg 1, this leg flap 11 not being illustrated in FIG. 1 for the sake of clarity. In the example illustrated, this leg flap 11 is sewn to the ice skate leg 1 with a first edge region 12, said edge region 12 lying approximately at region 12' in FIG. 1. From FIG. 3 it can be seen that the leg flap 11 has a substantially rectangular outline, which somewhat overlaps the recess 4 and thus its outer contour 5. The angle pad 6 is thus coverable from outside by the leg flap 11 when the leg flap 11 has been pivoted into the position shown in FIG. 3. The leg flap 11 has a second lacing region 13 with the eyelets 14. From FIG. 3 it can be seen that the second lacing region 2 and the eyelets 14 of the second lacing region 13 lie on a common line 15. The second lacing region 13 of the leg flap 11 lies in a second edge region 16, which is opposite the first edge region 12 (FIG. 2). Because the leg flap 11 thus is sewn to the skate leg 1 along the first edge region 12, the leg flap 11 can be pivoted toward or away from the ankle pad 6 in a pivoting plane perpendicular to the first edge region 12. In other words, the leg flap 11 can rotate about an axis which is parallel to said first edge region, 12. From FIG. 3 it can be seen that the pivoting plane of the leg flap 11 lies substantially in a normal 17 to the course 15 of leg lacing region 2 and second lacing region 13.

When the ice skate is put on, laces, not illustrated, lead through the eyelets 3 and 14 of the two lacing regions 2 and 13. The leg flap 11 is thus in the service position as in FIG. 3. Each ankle pad 6 lies against the wearer's ankle. The recess 4 of the ice skate leg 1 has been covered by the leg flap 11. If there are movements of the foot relative to the leg or if, to prevent such movements, the skate leg is subjected to severe stresses in the heel region and in the instep lacing region, the ankle pad 6 can deform in an elastic fashion; that is, in most cases it is compressed. When this happens, however, the ankle pad 6 strains against the wearer's ankle without shifting; there is thus no relative movement between ankle and ankle pad 6. In this way, neither the ice skate leg 1 nor the ankle pad 6 rub against the ankle, so that his ice skate is pleasant to wear. By means of the lacing in the eyelets 14 of the second lacing region 13, a tension is exerted on the leg flap 11 in the direction of the normal 17, by means of which tension the foot with its heel region is pressed into the ice skate. The foregoing explanations were made on the basis of the illustrated right flap of the ice skate; the left flap of the ice skate, not illustrated, is made as the mirror image thereof.

What I claim is:

1. An ice skate comprising a skate leg (1) having a recess filled by an ankle pad (6), the ankle pad (6) comprising at least four edges and being sewn along three of its edges to the skate leg (1), a leg flap (11) that is pivotably connected to the skate leg (1) along a first edge (12) of the leg flap (11), whereby the leg flap (11) may be pivoted towards the ankle pad (6) to a first position in which the leg flap (11) covers the ankle pad (6) and away from the ankle pad (6) to a second position in which the leg flap (11) does not cover the ankle pad (6), the leg flap (11) further including a lacing region (13) comprising a first set of eyelets (14), the ice skate leg further comprising a second set of eyelets (3) positioned below the leg flap (11), whereby the first set of eyelets (14) and the second set of eyelets (3) lie in a common line (15) when the leg flap (11) is pivoted to the first position in which the leg flap (11) covers the ankle pad (6).

* * * * *